US006554053B2

(12) United States Patent
Takata et al.

(10) Patent No.: US 6,554,053 B2
(45) Date of Patent: Apr. 29, 2003

(54) METHOD OF MINIMIZING THE SIZE OF PRIMARY SILICON IN AL-SI ALLOY

(75) Inventors: Kazuhiko Takata, Hamamatsu (JP); Yasuaki Kawai, Hamamatsu (JP); Mayuki Morinaka, Shizuoka (JP)

(73) Assignees: Tozuka-Tendo Co., Ltd (JP); Metal Science Ltd. (JP)

( * ) Notice: Subject to any disclaimer, the term of this patent is extended or adjusted under 35 U.S.C. 154(b) by 0 days.

(21) Appl. No.: 10/090,676

(22) Filed: Mar. 5, 2002

(65) Prior Publication Data

US 2002/0124985 A1 Sep. 12, 2002

Related U.S. Application Data

(63) Continuation of application No. 09/374,054, filed on Aug. 13, 1999, now abandoned.

(30) Foreign Application Priority Data

Aug. 25, 1998 (JP) ..... 10-276354

(51) Int. Cl.[7] ..... B22D 27/00

(52) U.S. Cl. ..... 164/55.1; 164/57.1

(58) Field of Search ..... 164/55.1, 56.1, 164/57.1, 58.1; 420/77, 78, 117, 537, 538; 123/193.1

(56) References Cited

U.S. PATENT DOCUMENTS

| | | | | |
|---|---|---|---|---|
| 5,106,436 A | * | 4/1992 | Alabi | 148/438 |
| 5,253,625 A | * | 10/1993 | Donahue et al. | 123/193.4 |
| 5,283,131 A | * | 2/1994 | Mori et al. | 428/623 |
| 5,303,682 A | * | 4/1994 | Donahue et al. | 123/193.1 |
| 6,200,396 B1 | * | 3/2001 | Laslaz et al. | 148/437 |

* cited by examiner

*Primary Examiner*—M. Alexandra Elve
*Assistant Examiner*—Kevin P. Kerns
(74) *Attorney, Agent, or Firm*—Muserlian, Lucas and Mercanti

(57) ABSTRACT

A method of minimizing the size of primary Si in Al—Si alloy which includes a step of adding P to molten Al—Si alloy, a step of contacting a metal substrate plated with Zn or a copper substrate, and a step of removing the substrate from the molten Al—Si alloy.

2 Claims, 1 Drawing Sheet

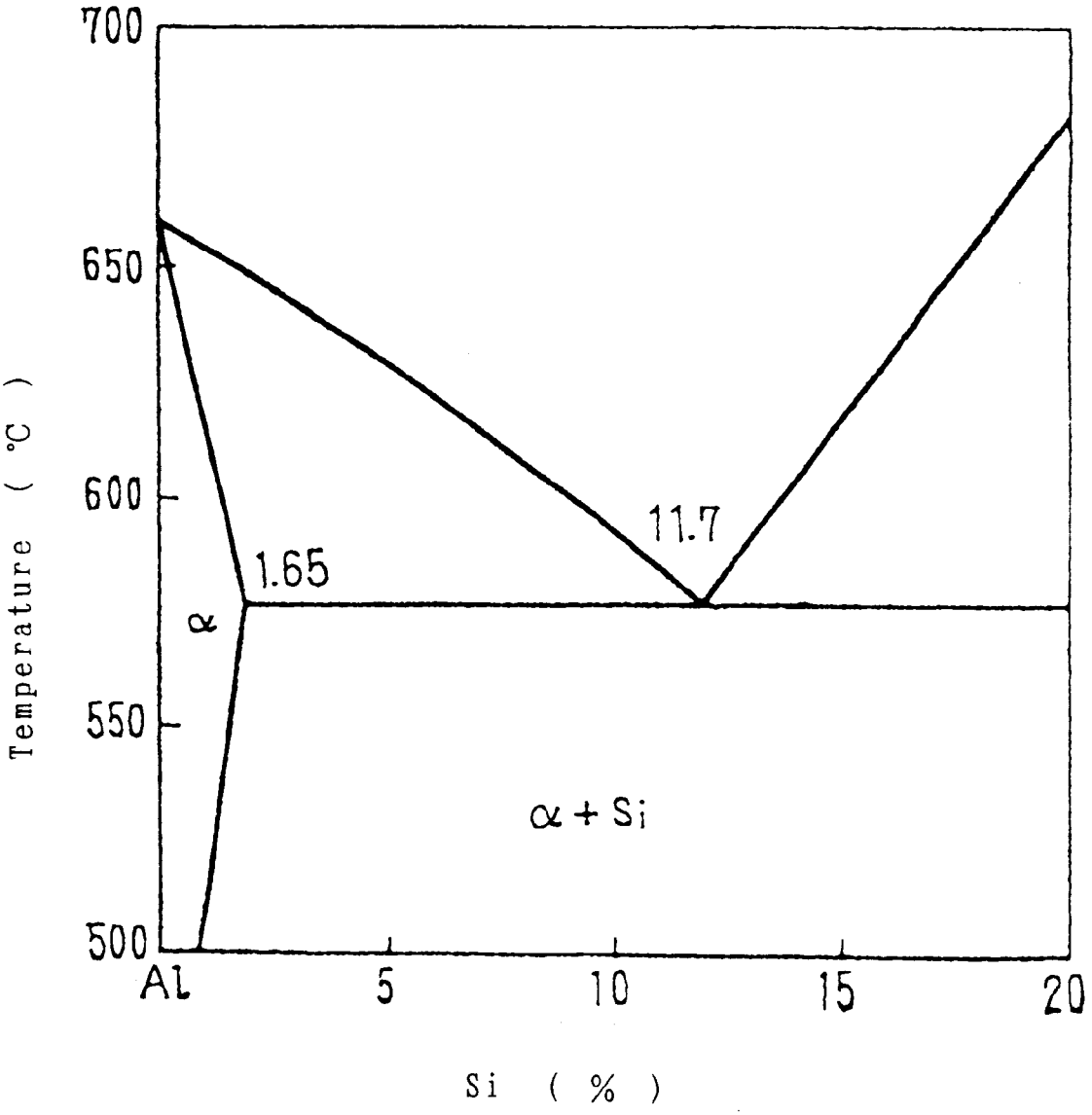
700
650
600
550
500
Temperature ( °C )
1.65
11.7
α
α + Si
Al
5
10
15
20
Si ( % )

METHOD OF MINIMIZING THE SIZE OF PRIMARY SILICON IN AL-SI ALLOY

PRIOR APPLICATION

This application is a Continuation of U.S. patent application Ser. No. 09/374,054 filed Aug. 13, 1999, now abandoned.

BACKGROUND OF THE INVENTION

This invention relates to a method of minimizing the size of primary silicon (Si) in Al—Si alloy.

Common aluminum alloys always may be classified by compositions, mechanical properties and typical applications depending upon their composing elements. Al—Si alloy, however, is characterized by relative high fluidity in a molten state, low contractibility and melting point, and high molding characteristics. Accordingly, recent attention has been given to Al—Si alloy.

According to an aluminum-silicon phase diagram, as shown in FIGURE, an Al side is an eutectic composition which consists of Si and α phase in which Si is not solidified.

Consequently, if the composition is coarse and rough, a casting material will be decreased in working ability.

In order to prevent the above disadvantage, usually phosphorus (P) has been added into molten Al—Si alloy so as to minimize the size of primary Si.

When phosphorus (P) is added into molten Al—Si alloy, Al in the molten alloy combines with P to form AlP. The formed AlP constitutes a nucleus of primary Si. It is necessary to raise the temperature of the molten alloy up to above 100° C. from the temperature of primary crystal formation. If not so, it is difficult to form AlP.

If the temperature of molten alloy is raised excessively, a large amount of hydrogen gas is melted into the molten alloy and forms pin-holes in a casting product.

When melting aluminum alloy is poured into a metal mold at low temperature, it has the hazard of shrinkage cavities in a casting aluminum alloy.

OBJECTS OF THE INVENTION

In view of the above, a main object of the invention is to provide a method of minimizing the size of primary silicon in Al—Si alloy which may easily be operated and available for good casting products.

It is a further object of the invention to provide a method of minimizing the size of primary Si in Al—Si alloy without having shrinkage cavities in a casting product.

BRIEF DESCRIPTION OF THE DRAWING

The FIGURE is the aluminum-silicon phase diagram of Al—Si Alloy.

DETAILED DESCRIPTION OF THE INVENTION

In order to attain the above objects, a method of the present invention consists of adding P to molten Al—Si alloy, and contacting the molten alloy with a metal substrate coated with zinc (Zn) or a copper substrate at very short time such as about 5 seconds.

When P is added into the molten Al—Si alloy at about 800° C. and contacted with a metal substrate plated with Zn or a copper substrate, Zn or Cu is combined with P to form ZnP or CuP, and the temperature of the molten Al—Si alloy which surrounds the substrate drops to about 400° C.

At about 400° C., P is separated from the molten Al—Si—P alloy and combined with Zn or Cu to form ZnP or CuP. That is, Al—Si—P formed in the molten alloy is decomposed temporally.

As the time of contact of the metal substrate with the molten Al—Si—P is about 5 seconds, the temperature of the molten alloy is returned to about 800° C., and forms Al—Si—P.

Crystals of Al—Si—P floating in the molten alloy combine with each other to make up a bundle, and crystals forming the nucleus in the primary silicon are decreased.

Accordingly, after the size of primary silicon in molten Al—Si alloy is minimized in accordance with the present invention, and then the molten alloy is casted and solidified, it is possible to obtain a Al—Si alloy casting product in which the size of primary silicon is more minimized than the usual one.

EXPERIMENT I 5 kg of Japanese Industrial Standard (JIS) AC9A alloy which contains 23% Si and P is added thereto is melted at 830° C. by means of an electric furnace.

A thermocouple was placed in a center of a metal mold made of cast iron and heated to approximately 1500° C.

The molten AC9A alloy was poured into the mold by using a graphite crucible.

In order to apply the method of the present invention, an iron grid plated with Zn or a copper grid was immersed in the molten AC9A alloy in about 5 seconds.

In this experiment, the freezing rate of the molten AC9A alloy was 10° C./sec. Cooling temperature from primary temperature (730° C.) to 500° C. and the molten alloy was completely solidified.

The size of a solidified primary Si was about 25 μm.

EXPERIMENT II

In order to compare the result of the method according to the present invention with the result of the conventional method, 300 kg of molten AC9A alloy to which P was already added was melted by a gas furnace to make a piston to be used in an internal combustion engine.

Usually, the molten alloy may directly be poured into a metal mold, but in this experiment the molten AC9A alloy was poured into a sprue hole in the mold to which an iron grid plated with Zn was placed.

In this experiment, 830° C. and 790° C. of the molten AC9A alloy were respectively poured into the molds heated to 350° C. and 400° C. so as to examine the generation of shrinkage cavities.

In addition to the above, the formation of shrinkage cavities was examined in a number of metal molds by changing the temperatures thereof, the results were shown as in the following table.

TABLE

| Temperature of the Mold (° C.) | 400 | 350 |
|---|---|---|
| Conventional Method | No Shrinkage | Shrinkage |
| Present Invention | No Shrinkage | No Shrinkage |

As it is obvious from the above, according to the method of the present invention, it is possible to obtain minimized primary Si much less than the conventional method.

Consequently, the casting products prepared by using the method of the present invention have superior mechanical properties and working abilities than those obtained by the conventional method.

Further, according to the present invention, the size of primary Si in molten Al—Si alloy will be minimized, and shrinkage cavities will not be formed in the casting even if the temperature of the metal mold is lowered.

What is claimed is:

1. A method of minimizing the size of primary silicon in Al—Si alloy comprising a) adding phosphorus (P) to molten Al—Si, b) contacting said molten Al—Si alloy with a metallic substrate plated with Zn or copper for forming ZnP or CuP and for temporarily reducing the temperature of said molten alloy, c) standing said molten alloy for a very short time to return the temperature of said molten alloy to its original temperature for forming Al—Si—P.

2. The method of claim 1 wherein said very short time is about 5 seconds.

* * * * *